252-103 AU 166 EX
2/3/81 OR 4,248,728

United States Patent [19]
Puryear
[11] 4,248,728
[45] Feb. 3, 1981

[54] LIQUID SCOURING CLEANSER

[75] Inventor: Robert L. Puryear, Cincinnati, Ohio
[73] Assignee: Chemed Corporation, Cincinnati, Ohio

[21] Appl. No.: 16,310
[22] Filed: Feb. 28, 1979
[51] Int. Cl.[3] ..... C11D 7/56
[52] U.S. Cl. ..... 252/103; 252/95; 252/99; 252/135; 252/179
[58] Field of Search ..... 252/99, 95, 103, 135, 252/179

[56] References Cited

U.S. PATENT DOCUMENTS

| | | | |
|---|---|---|---|
| 3,929,678 | 12/1975 | Laughlin | 252/526 |
| 3,962,132 | 6/1976 | Haschke | 252/179 X |
| 3,985,668 | 10/1976 | Hartman | 252/103 X |
| 4,005,027 | 1/1977 | Hartman | 252/103 X |
| 4,051,055 | 9/1977 | Trinh et al. | 252/103 X |
| 4,051,056 | 9/1977 | Hartman | 252/99 |
| 4,094,778 | 6/1978 | Denny et al. | 252/179 X |
| 4,116,851 | 9/1978 | Rupe et al. | 252/103 |

FOREIGN PATENT DOCUMENTS

| | | | |
|---|---|---|---|
| 2439572 | 3/1975 | Fed. Rep. of Germany | 252/179 |

*Primary Examiner*—Mayer Weinblatt
*Attorney, Agent, or Firm*—Charles L. Harness

[57] ABSTRACT

A paste type scouring cleanser containing colloidal magnesium aluminum silicate, alkali, optionally a bleach, zeolite, optionally an abrasive, a surfactant, and optionally sodium hexametaphosphate, all in aqueous dispersion.

6 Claims, No Drawings

LIQUID SCOURING CLEANSER

The present invention is directed to a general purpose scouring cleanser in an easy to use cream form that can be dispensed from a squeeze-type bottle. It may or may not contain phosphates, bleach, or abrasives.

The formulation is characterized by its content of sodium aluminum silicate (zeolite). The zeolite provides several useful functions. It balances the suspension of abrasives when abrasives are present, thus concurrently preventing settling while maintaining sufficient fluidity to permit dispensing in a squeeze bottle. Also the zeolite itself provides a degree of mild non-scratch abrasive for use in cleaning. Thirdly, the zeolite provides a degree of water hardness control to lessen potential or residual film formation. Furthermore it aids in removal of old films. This use of a zeolite appears novel for this type of cleanser. Zeolites have been used in the past in laundry detergent formulations, and in toothpastes.

Thus, U.S. Pat. No. 4,005,027 shows a cream cleanser lacking a zeolite. U.S. Pat. Nos. 3,803,301 and 3,935,306 show the use of aluminosilicates in dentifrices. U.S. Pat. No. 4,051,055 shows a "false body" cleanser which may contain an unstated amount of a zeolite, but which requires a soluble fluoride. The instant composition differs in that, inter alia, it excludes fluorides. Zeolite use in scouring cleansers of the instant type is believed to be novel.

The instant formulation provides several advantages. It offers superior cleaning of porcelain, tile, chrome, enamel, and other hard surfaces when used in rub and rinse method. My composition does not settle in the container. It is easily dispensed from a squeeze-type bottle. It clings to vertical surfaces, thereby facilitating application to walls and the like. It contains at most, non-scratch mild abrasives, and no harsh abrasives. It is easily rinsed. It offers chlorine stability, when a chlorine source or other bleach is included.

The following table sets forth the preferred composition as well as the operable range for the composition.

TABLE 1

| Component | Preferred Formula, Wt. % | Operable Range, Wt. % |
|---|---|---|
| Water | 43.5 | 40-65 |
| Colloidal magnesium aluminum silicate | 3.5 | 1-5 |
| Alkali | 1.5 | 1-5 |
| Bleaching agents, 5.25% aqueous soln. | 20.0 | 0-40 |
| Dry basis | 1.0 | 0-2 |
| Sodium aluminum silicate (zeolite) | 10.0 | 10-50 |
| Abrasive material | 20.5 | 0-25 |
| Surfactant | 1.0 | 0.5-2.0 |
| Sodium hexametaphosphate | 0 | 0-15 |
| | 100.0 | |

With reference to the Preferred Formula in Table 1, the following are the preferred specific components.

(1) The colloidal magnesium silicate is Veegum T, sold by R. T. Vanderbilt Company.

(2) The alkali is anhydrous sodium metasilicate.

(3) The bleaching agent is sodium hypochlorite, 5.25 wt. % aqueous solution.

(4) The sodium aluminum silicate is zeolite 4A, available commercially from several sources, e.g., W. R. Grace & Co. The formula is typically $Na_{12}(AlO_2.SiO_2)_{12}X\text{-}H_2O$, where X is generally about 0-30. As sold, X is typically 1-2, and when the zeolite is added to water it rapidly hydrates, taking up as much as 30 moles of water.

(5) The surfactant is sodium lauryl ether sulfate, a conventional anionic detergent.

The functions of the ingredients are as follows:

Water serves as a diluent, carrier and viscosity control for desirable packaging and dispensing.

Sodium Lauryl Ether Sulfate provides surfactant action for wetting, penetration of the soil and cleaning action.

Veegum T imparts specific thixotropy to the formula to aid suspension of the pigments while maintaining thin enough body for easy dispensing.

Zeolite acts as a "builder" providing water hardness control and also as a mild abrasive in the formula.

Calcium carbonate acts as a mild abrasive to remove soil by physical abrasion.

COLLOIDAL MAGNESIUM ALUMINUM SILICATE (CLAY)

From about 1-5 wt. %, preferably about 3.5%, of the instant composition is a colloid-forming magnesium aluminum silicate clay. The preferred clays are the magnesium aluminum silicate clays disclosed in U.S. Pat. No. 4,005,027, e.g., hectorites or modified hectorites (types of smectites).

The smectite clays used in the compositions herein are all commercially available. Such clays include, for example, montomorillonite (bentonite) volchonskoite, nontronite, beidellite, hectorite, saponite, sauconite and vermiculite. The clays herein are available under trade names such as Thixogel No. 1 and Gelwhite GP from Georgia Kaolin Company, Elizabeth, N.J. (both montmorillonites); Volclay BC and Volclay No. 325, from American Colloid Company, Skokie, Ill.; Black Hills Bentonite BH 450, from International Minerals and Chemicals; Veegum Pro and Veegum F, from R. T. Vanderbilt (both hectorites); Barasym NAS-100, Barasym NAH-100, Barasum SMM 200, and Barasym LIH-200, all synthetic hectorites and saponites marketed by Baroid Division, NL Industries, Inc.

The clay component serves as a suspending agent for the zeolite and abrasive material. Veegum T, a colloidal magnesium aluminum silicate clay available commercially from R. T. Vanderbilt Co., is preferred. It imparts specific thixotropy to the formula to aid suspension of the particulates while maintaining thin enough body for easy dispensing. A typical analysis of Veegum T is:

| | % |
|---|---|
| $SiO_2$ | 61.1 |
| MgO | 13.7 |
| $Al_2O_3$ | 9.3 |
| $TiO_2$ | 0.1 |
| $Fe_2O_3$ | 0.9 |
| CaO | 2.7 |
| $Na_2O$ | 2.9 |
| $K_2O$ | 2.9 |
| $CO_2$ | 1.8 |
| $H_2O$ of combination | 7.2 |

ALKALI

The alkali provides alkalinity for cleaning and, when a chlorine source is present, maintains the pH at a high level (11-14) to maintain chlorine stability. The preferred alkali is sodium metasilicate. Useful alternates (whether chlorine is present or absent) are caustic soda, trisodium phosphate, sodium carbonate, sodium phosphates, and sodium tetraborate.

When sodium hypochlorite or other chlorine source is included in the formulation, any bleach-stable material or mixture of materials which has the effect of altering composition pH to within the 11 to 14 range and maintaining it there can be utilized as the alkali in the instant invention. Such materials can include, for example, various water-soluble, inorganic salts such as the carbonates, bicarbonates, sequiscarbonates silicates, pyrophosphates, phosphates, tetraborates, and mixtures thereof. Examples of materials which can be used either alone or in combination as the buffering agent herein include sodium carbonate, sodium bicarbonate, sodium sesquicarbonate, sodium silicate, tetrapotassium pyrophosphate, trisodium phosphate, anhydrous sodium tetraborate, sodium tetraborate pentahydrate and sodium tetraborate decahydrate.

BLEACHING AGENT (CHLORINE SOURCE)

In one embodiment the composition may include a bleaching agent of the type which yields a hypochlorite species in aqueous solution. The hypochlorite ion is chemically represented by the formula $OCl^-$. The hypochlorite ion is a strong oxidizing agent and for this reason materials which yield this species are considered to be powerful bleaching agents.

The strength of an aqueous solution containing hypochlorite ion is measured in terms of available chlorine. This is the oxidizing power of the solution measured by the ability of the solution to liberate iodine from an acidified iodide solution. One hypochlorite ion has the oxidizing power of 2 atoms of chlorine, i.e., one molecule of chlorine gas.

At lower pH levels, aqueous solutions formed by dissolving hypochlorite-yielding compounds contain active chlorine partially in the form of hypochlorous acid moieties and partially in the form of hypochlorite ions. At pH levels above about 10, i.e., at pH levels of the instant compositions, essentially all of the active chlorine is in the form of hypochlorite ion.

Those bleaching agents which yield a hypochlorite species in aqueous solution include alkali metal and alkaline earth metal hypochlorites, hypochlorite addition products, chloramines, chlorimines, chloramides, and chlorimides. Specific examples of compounds of this type include sodium hypochlorite, potassium hypochlorite, monobasic calcium hypochlorite, dibasic magnesium hypochlorite, chlorinated trisodium phosphate dodecahydrate, potassium dichloroisocyanurate, sodium dichloroisocyanurate, and N-chlorosulfamide. A preferred bleaching agent for use in the compositions of the instant invention is sodium hypochlorite.

Most of the above described hypochlorite-yielding bleaching agents are available in solid or concentrated form and are dissolved in water during synthesis of the compositions of the instant invention. some of the above materials are available as aqueous solutions.

SODIUM ALUMINUM SILICATE (ZEOLITE)

The formulation utilizes a zeolite, a basic hydrated silicate of aluminum. The zeolite contributes multiple properties to the formula as follows:

1. Balances the suspension of the abrasives, thus concurrently preventing settling and maintaining sufficient fluidity to permit dispensing in a squeeze bottle.
2. Provides a degree of mild, non-scratch abrasive for aid in cleaning.
3. Provides a degree of water hardness control to lessen the potential for residual film formation and aids in removal of old films.

The zeolite is more precisely defined as a water insoluble crystallizing aluminosilicate ion exchange material of the formula $Na_{12}[AlO_2SiO_2]_{12}xH_2O$ wherein x is an integer of from about 20 to 30, said aluminosilicate having a particle size range of from about 0.2 micron to about 10 microns, having a calcium ion exchange capacity of at least about 200 mg. eq. $CaCO_3$/g. and an ion exchange rate with calcium of at least about 2 grains of calcium ion per gallon per minute per gram. Also known as Zeolite 4A, it can be made by the process of U.S. Pat. No. 2,882,243 to Milton.

ABRASIVE MATERIAL

My compositions preferably contain an insoluble particulate abrasive material. Such insoluble materials have particle size diameter ranging from about 1 to about 250 microns and specific gravities of from about 0.5 to about 5.0. It is preferred that the diameter of the particles range from about 2 microns to about 60 microns and that their specific gravity range from about 1.0 to about 2.8. Insoluble abrasive particulate material of this size and specific gravity can easily be suspended in the compositions of the instant invention in their quiescent state.

The abrasives which can be utilized include, but are not limited to, quartz, pumice, pumicite, titanium dioxide ($TiO_2$), silica sand, calcium carbonate, zirconium silicate, diatomaceous earth, whiting and feldspar. Calcium carbonate is the preferred abrasive for use in the instant compositions.

Although the zeolite has some mild abrasive action, the term "abrasive", as used herein, refers to abrasives per se, other than the zeolite.

SURFACTANT

The surfactant provides wetting, penetration of the soil, and cleaning action. If no sodium hypochlorite is present, the surfactant can be any conventional surfactant, e.g., non-ionics (e.g., the ethoxylated alcohols), phosphate esters, linear alkyl benzene sulfonic acid, alpha olefin sulfonates, and the like; as well as the chlorine-stable materials in the following group.

CHLORINE-STABLE SURFACTANTS

When sodium hypochlorite is present, a chlorine-stable surfactant should be used. Sodium lauryl ether sulfate is preferred. Another useful surfactant is sodium lauryl sulfate, the alkane sulfonates, and the like. Surfactants which are especially resistant to hypochlorite oxidation fall into two main groups. One such class of bleach-stable surfactants are the water-soluble alkyl sulfates containing about 8 to 18 carbon atoms in the alkyl group. Alkyl sulfates are the water-soluble salts of sulfated fatty alcohols. They are produced from natural or synthetic fatty alcohols containing from about 8 to 18 carbon atoms. Natural fatty alcohols can also be produced synthetically, for example, by the Oxo process. Examples of suitable alcohols which can be employed in alkyl sulfate manufacture include decyl, lauryl, myristyl, palmityl and stearyl alcohols and the mixtures of fatty alcohols derived by reducing the glycerides of tallow and coconut oil.

Specific examples of alkyl sulfate salts which can be employed in the instant detergent compositions include sodium lauryl alkyl sulfate, sodium stearyl alkyl sulfate sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, potassium dodecyl sulfate, potassium tallow alkyl sulfate, sodium tallow alkyl sulfate, sodium coconut alkyl sulfate, potassium coconut alkyl sulfate and mixtures of these surfactants. Highly preferred alkyl sulfates are sodium coconut alkyl sulfate, potassium coconut alkyl sulfate, potassium lauryl alkyl sulfate and sodium lauryl alkyl sulfate.

When a bleach is not included the following formula is preferred:

| | Wt. % |
|---|---|
| Water | 63.5 |
| Colloidal magnesium aluminum silicate[1] | 3.5 |
| Alkali[2] | 1.5 |
| Sodium aluminum silicate (zeolite)[3] | 10.0 |
| Abrasive[4] | 20.0 |
| Anionic surfactant[5] | 1.0 |

[1]Preferably Veegum T. R. T. Vanderbilt Co.
[2]Preferably sodium metasilicate, anhydrous
[3]Preferably zeolite 4A. W. R. Grace & Co.
[4]Preferably finely divided calcium carbonate.
[5]Preferably sodium lauryl ether sulfate.

The formulations stated were arrived at after a long series of unsatisfactory experiments with similar materials. For example, I obtained poor results with:

(1) Oleate base, silica abrasive, and isopropyl alcohol for control of consistency. The products were either too thin (allowed settling) or were too thick for dispensing. Where the abrasive was switched to zeolite, no improvement in consistency was noted.
(2) A vinyl carboxy polymer (Carbopol 941) was added to improve consistency, but without success.
(3) An oleate-zeolite-sodium hexametaphosphate material was reasonably successful as to consistency, but was discarded because of the phosphate requirement.
(4) Formulations that included sodium lauryl ether sulfate and zeolite but which lacked colloidal magnesium aluminum silicate and calcium carbonate did not achieve adequate suspension and consistency properties.

Finally, the formulas as herein described did give the degree of thixotropy and viscosity for non-settling and ease of dispensing desired.

The following example illustrates without limiting the invention:

EXAMPLE 1

Equipment suitable for preparing the mix suitably includes, as mixing vessel, a plastic lined, nonpressured, baffled water jacketed tank or kettle, with a variable or multi-speed motor driven agitator capable of speeds of 50–150 rpm. Suitably, the agitator blade is a pitched turbine, and the blade length is suitably such that they traverse 50–60% of the kettle diameter. Recommended order of addition and mixing details are:

1. Water (heated to 150°–160° F.)
2. Veegum T

Mix at high speed until completely dissolved, 10–15 minutes, then cool to 76°–80° F. After cooling, add the next four ingredients, while continuing to agitate at high speed.

3. Sodium Metasilicate—anhydrous
4. Sodium Hypochlorite—5.25%
5. Calcium Carbonate—add slowly
6. Zeolite 4A—add slowly Mix until thoroughly dispersed. About 30 minutes. Then adjust agitator speed to low setting to avoid foaming when surfactant is added. Add 7. Sodium Lauryl Ether Sulfate Mix at low speed until uniform. 10–15 minutes.

I claim:

1. A general purpose scouring cleanser in cream form consisting of:

| | Wt. % |
|---|---|
| Water, to make balance of 100% | |
| Colloidal magnesium aluminum silicate, about | 1–5 |
| Alkali, about | 1–5 |
| Sodium aluminum silicate, about | 10–50 |
| Abrasive, about | 0–25 |
| Chlorine-stable anionic surfactant, about | 0.5–2.0 |
| Bleach (dry basis), about | 0–2 |
| Sodium hexametaphosphate, about | 0–15 |

said colloidal magnesium aluminum silicate being a member selected from the group consisting of:

hectorites, modified hectorites, smectites, montmorillonite, bentonite, volchonskoite, nontronite, beidellite, saponite, or sauconite;

said alkali being sufficient to maintain the pH in the range of 11–14;

said sodium aluminum silicate being a water insoluble crystallizing aluminosilicate ion exchange material of the formulas $Na_{12}[AlO_2SiO_2]_{12}xH_2O$ wherein x is an integer of from about 20 to about 30;

said abrasive being a member selected from the group consisting of quartz, pumice, pumicite, titanium dioxide, silica sand, calcium carbonate, zirconium silicate, diatomaceous earth, whiting, or feldspar, and having a particle size diameter ranging from about 1 to about 250 microns and a specific gravity of from about 0.5 to about 5.0;

said bleach being a member selected from the group consisting of;

sodium hypochlorite, potassium hypochlorite, monobasic calcium hypochlorite, dibasic magnesium hypochlorite, chlorinated trisodium phosphate dodecahydrate, potassium dichloroisocyanurate, sodium dichloroisocyanurate, or N-chlorosulfamide.

2. Cleanser according to claim 1 consisting of

| | Wt. % |
|---|---|
| Water, about | 40–65 |
| Colloidal magnesium aluminum silicate, about | 1–5 |
| Sodium metasilicate anhydrous, about | 1–5 |
| Zeolite 4A, about | 10–50 |
| Calcium carbonate, about | 0–25 |
| Sodium lauryl ether sulfate, about | 0.5–2.0 |
| Sodium hypochlorite, 5.25 wt. % aqueous solution, about | 0–40 |
| Sodium hexametaphosphate, about | 0–15 |

3. Cleanser according to claim 1 consisting of:

| | Wt. % |
|---|---|
| Water, to make balance of 100% | |
| Colloidal magnesium aluminum silicate, about | 3.5 |
| Alkali, about | 1.5 |
| Sodium aluminum silicate, about | 10.0 |
| Abrasive, about | 20.5 |
| Anionic surfactant, about | 1.0 |
| Bleach (dry basis), about | 1.0 |

4. Cleanser according to claim 3 consisting of:

| | Wt. % |
|---|---|
| Water about | 43.5 |
| Colloidal magnesium aluminum silicate, about | 3.5 |
| Sodium metasilicate, anhydrous, about | 1.5 |
| Zeolite 4A, about | 10.0 |
| Calcium carbonate, about | 20.5 |
| Sodium lauryl ether sulfate, about | 1.0 |

-continued

| | Wt. % |
|---|---|
| Sodium hypochlorite (5.25 wt. % aqueous solution), about | 20.0 |

5. Bleach-free cleanser according to claim 2 consisting of:

| | Wt. % |
|---|---|
| Water, about | 63.5 |
| Colloidal magnesium aluminum silicate, about | 3.5 |
| Alkali, about | 1.5 |
| Sodium aluminum silicate, about | 10.0 |
| Abrasive, about | 20.5 |
| Anionic surfactant, about | 1.0 |

6. Cleanser according to claim 5 in which the alkali is anhydrous sodium metasilicate; the sodium aluminum silicate is zeolite 4A; the abrasive is finely divided calcium carbonate; and the surfactant is sodium lauryl ether sulfate.

* * * * *